US006035859A

United States Patent [19]

Antonopoulos-McIvor

[11] Patent Number: 6,035,859

[45] Date of Patent: Mar. 14, 2000

[54] TOOL FOR REMOVING FINGER NAIL POLISH

[75] Inventor: Frances Antonopoulos-McIvor, Kent, Wash.

[73] Assignee: Aquarius II, Inc.

[21] Appl. No.: 09/162,664

[22] Filed: Sep. 29, 1998

[51] Int. Cl.[7] ..... A45D 29/18

[52] U.S. Cl. ..... 132/74.5; 132/320; 401/131

[58] Field of Search ..... 132/73, 73.5, 74.5, 132/75.6, 317, 320; 401/131, 139, 148, 196, 198, 207

[56] References Cited

U.S. PATENT DOCUMENTS

| | | |
|---|---|---|
| D. 113,633 | 3/1939 | Kahn . |
| D. 202,874 | 11/1965 | Luedtke . |
| D. 256,171 | 7/1980 | Tomaro . |
| D. 296,763 | 7/1988 | Holmstadt et al. . |
| D. 334,081 | 3/1993 | Lampasona . |
| 373,701 | 11/1887 | Underwood . |
| 851,115 | 4/1907 | Burdick . |
| 1,220,824 | 3/1917 | Conway . |
| 1,362,601 | 12/1920 | Chandler . |
| 2,279,520 | 4/1942 | Perillo . |
| 2,360,457 | 10/1944 | Wells . |
| 2,399,463 | 4/1946 | Bryant . |
| 2,509,550 | 5/1950 | Woods . |
| 2,567,764 | 9/1951 | Davies . |
| 2,568,907 | 9/1951 | Bernstein . |
| 2,713,693 | 7/1955 | Johnson . |
| 2,722,224 | 11/1955 | Blann . |
| 2,820,234 | 1/1958 | Rigney . |
| 2,841,809 | 7/1958 | Oliver . |
| 2,876,782 | 3/1959 | Hudgens . |
| 2,930,061 | 3/1960 | O'Neil . |
| 3,148,401 | 9/1964 | Gilchrist et al. . |
| 3,341,884 | 9/1967 | Pryor . |
| 4,022,228 | 5/1977 | Ropp et al. . |
| 4,078,865 | 3/1978 | Moser . |
| 4,321,936 | 3/1982 | Chaconas . |
| 4,466,452 | 8/1984 | Ferrari . |
| 4,474,195 | 10/1984 | Warner . |
| 4,699,161 | 10/1987 | Smith et al. . |
| 4,854,761 | 8/1989 | Smith et al. . |
| 4,884,913 | 12/1989 | Smith et al. . |
| 4,889,441 | 12/1989 | Tice . |
| 4,961,661 | 10/1990 | Sutton et al. . |
| 4,998,839 | 3/1991 | Bashir . |
| 5,299,877 | 4/1994 | Birden . |
| 5,353,819 | 10/1994 | Kahn et al. . |

FOREIGN PATENT DOCUMENTS

| | | |
|---|---|---|
| 1416928 | 9/1965 | France . |
| 748246 | 4/1956 | United Kingdom . |

*Primary Examiner*—Todd E. Manahan
*Attorney, Agent, or Firm*—Donald W. Margolis; Emery L. Tracy

[57] ABSTRACT

The present invention is a hand-held nail polish removal tool for use in removing nail polish, The tool comprises a hollow base portion for receiving and containing nail polish remover. A cap portion is secured to the hollow base portion with the nail polish remover receivable into the cap portion from the hollow base portion. At least one rest member is secured to either or both the hollow base portion and/or the cap portion. A porous applicator material is removably secured to the cap portion with the nail polish remover receivable into the porous material from the cap portion and substantially retainable within the porous material such that contacting pressure of the porous material with a fingernail or the like releases at least a partial amount of the nail polish remover from the porous material onto the fingernail or the like. The rest member maintains a fluid level of the nail polish remover at a position below the porous applicator material when the removal tool is positioned upon a substantially level horizontal surface.

16 Claims, 1 Drawing Sheet

TOOL FOR REMOVING FINGER NAIL POLISH

BACKGROUND OF THE INVENTION

1. Technical Field

The present invention relates to a nail device. More particularly it relates to such a device with a combined storage cavity for fluent material, it and a feed for such fluent material for use in fingernail polish removal.

2. Background Art

Many prior art liquid applicators have a reservoir in the form of a hollow handle portion, an open end portion integral with or connected to the reservoir in the hollow handle portion, and an external feed element or applicator as a portion of the open end portion. The hollow handle portion typically stores a fluid, and, upon manipulating the fluid applicator, for example by tipping it so that the applicator is level with or below the reservoir, the fluid is transferred by gravity to the open end portion to be distributed by the fluid applicator to a desired location. Such fluid applicators are most often used at a work station having a flat surface such as a table, desk, counter top or the like, and there is a tendency to want to store them on such a surface, or in a drawer or cabinet. However, such fluid applicators have heretofore been constructed in manner such that when they contain fluid and are placed in a generally horizontal position, for example on a flat surface, with the level of fluid in the hollow handle higher then open end portion, the fluid tends to leak from the open end portion. This presents more or less of a problem, depending on the composition of the fluid. As a result, such fluid applicators must either be drained after each use, or placed in a container, such as a cup, so that the open end portion is higher than the fluid in the reservoir. Both of these solutions are inconvenient.

In the known prior art, Burdick, U.S. Pat. No. 851,115, describes an envelope moistener having a pear-shaped water containing bulb with a distributing pad upon the smaller end. A polygonal flange is located circumferentially around the smaller end of the bulb to stabilize the bulb against rolling, but the flange is of such dimensions that, when the moistener lays in a recumbent position the distributing pad normally remains below the water-level within the bulb. Unfortunately, when in this position fluid within the bulb will tend to leak through the distributing pad.

Other known prior art fluid applicators include Chandler U.S. Pat. No. 1,362,601; Perillo U.S. Pat. No. 2,279,520; Wells U.S. Pat. No. 2,360,457; Bryant U.S. Pat. No. 2,399,463; Peterson U.S. Pat. No. 2,509,550; Davies U.S. Pat. No. 2,567,764; Blann U.S. Pat. No. 2,722,224; Rigney U.S. Pat. No. 2,820,234; O'Neil U.S. Pat. No. 2,930,061; Gilchrist et al. U.S. Pat. No. 3,148,401; Pryor U.S. Pat. No. 3,341,884; Moser U.S. Pat. No. 4,078,865; Ferrari U.S. Pat. No. 4,466,452; Sutton et al. U.S. Pat. No. 4,961,661; Birden U.S. Pat. No. 5,299,877; Kahn et al. U.S. Pat. No. 5,353,819; Luedtke U.S. Pat. Des. 202,874; Tomaro U.S. Pat. Des. 256,171; Holmstadt et al. U.S. Pat. No. Des. 296,763 and Lampasona U.S. Pat. Des. 334,081.

None of the known prior art fluid applicators allow a user to place a fluid applicator which contains fluid by itself in a stable, substantially horizontal position in a manner such that the fluid contained within the reservoir will not tend to leak from the open end portion of the applicator.

DISCLOSURE OF THE INVENTION

It is therefore a primary object of the present invention to provide fluid applicators which allow a user to place a fluid applicator which contains fluid by itself in a stable, substantially horizontal position in a manner such that the fluid contained within the reservoir will not tend to leak from the open end portion of the applicator.

The present invention provides fluid applicators, especially in the form of hand-held nail polish removal tools for use in removing nail polish which allow a user to place such nail polish removal applicator tools in a stable, substantially horizontal position in a manner such that the nail polish removal fluid contained within the reservoir of the tools will not tend to leak from the open end portion of the applicator. The tool comprises a hollow handle portion including a reservoir for receiving and containing nail polish remover fluid. In preferred embodiments, a cap portion having an open end portion is removably secured to the hollow handle portion. A fluid applicator material is secured at the open end portion of the cap. The nail polish remover fluid may be easily poured into or removed from the reservoir of the handle portion when the cap portion is removed. Thereafter, when the tool is oriented with the, open end portion at or below the level of the nail polish remover in the reservoir, the fluid readily flows into the cap portion from the hollow handle portion by gravity, and thence to the open end portion to be distributed by the fluid applicator for use in nail polish removal. At least one rest member is secured to or integral with either or both the hollow handle portion or the cap portion. The fluid applicator secured at the open end portion of the cap portion is preferably composed of porous material. Nail polish remover fluid is received into the porous material of the applicator through the open end portion of the cap portion and is retained within the porous material. In use, contacting a painted fingernail with the porous material containing nail polish remover fluid with some pressure releases at least a partial amount of the fluid nail polish remover from the porous material onto the fingernail. Thereafter, scrubbing action of the fluid nail polish remover containing porous material onto the painted fingernail removes the nail polish from the fingernail, all without allowing fluid nail polish remover to touch the fingers, fingernails, or the hands of the user of the tool. Thence, as explained in greater detail below, when the use of the tool is completed, the rest member allows a user to place the nail polish removal applicator tool in a stable, substantially horizontal position in a manner such that the nail polish removal fluid contained within the reservoir of the tool will not tend to leak from the open end portion of the applicator cap.

In one embodiment of the present invention the tool comprises the rest member being associated with the hollow handle. In another embodiment of the present invention the tool of the present invention comprises the rest member being associated with the cap portion. In the preferred embodiment of the present invention the removal tool of the present invention comprises rest members being associated with both the handle and the cap portion. In still another preferred embodiment, the removal tool of the present invention comprises a planar surface be angularly formed in the distal end of the handle portion in a manner such that the planar surface cooperates with the rest member allowing the removal tool to be positioned in a substantially stable resting position on a substantially level surface.

In various embodiments of the nail polish removal tool of the present invention comprises the cap portion being releasably secured to the hollow portion by either slide fit, by corresponding threads on the hollow portion and the cap portion, or by any other art known equivalent mechanism. Preferably, the cap portion has a seat and the porous material is replaceable. For example, the porous material cleaning pad is releasably secured within the seat of the cap portion by sliding friction, by slide fit, or by any other art known equivalent mechanism. The cleaning pad may be comprised of a single unitary element, or may have a first layer and a second layer with the first layer being secured to the cap portion and the second layer applying the nail polish remover fluid. Furthermore, the open end portion of the applicator cap preferably has a curved passageway extending from the hollow handle portion to the seat for transferring the nail polish remover fluid from the reservoir of the hollow handle portion to the porous material releasably secured with the seat of the cap portion.

The present invention further includes a method for removing nail polish from a fingernail and the like, and storing the nail polish after use. The method of the present invention comprises first introducing nail polish remover into the reservoir in the hollow handle portion. Second, the cap portion is secured to the hollow handle portion with the nail polish remover receivable into the cap portion from the hollow handle portion. Third, a porous material is removably secured to the cap portion with the nail polish remover receivable into the porous material from the cap portion and substantially retainable within the porous material in manner such that the combined hollow handle portion, cap portion, and porous material comprise a nail polish removal tool. Fourth, the porous material is applied with pressure to a painted fingernail, or the like, to thereby release nail polish remover fluid from the porous material. Finally, the fluid level of the nail polish remover is maintained at a position below the porous material when the removal tool is placed on the rest or rests in a substantially horizontal position.

In an embodiment of the present invention, the method comprises maintaining the fluid level below the porous material when the removal tool is placed in a substantially horizontal position by providing rest or rest members, for example to both or either the hollow handle portion or the cap portion. In one embodiment, the rest member is secured to the hollow handle portion. In another embodiment, the rest member is secured to the cap portion. In the preferred embodiment the rest members are associated with both the handle and the cap portion, and a planar surface is formed in the distal end of the hollow handle portion, with the planar surface cooperating with the rest members, thereby allowing the removal tool to be positioned in a substantially stable resting position on the substantially level horizontal surface.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawing which is incorporated in and forms a part of the specification illustrates complete preferred embodiments of the present invention according to the best modes presently devised for the practical application of the principles thereof, and in which.

BEST MODE FOR CARRYING OUT THE INVENTION AND INDUSTRIAL APPLICABILITY

Figure 3:
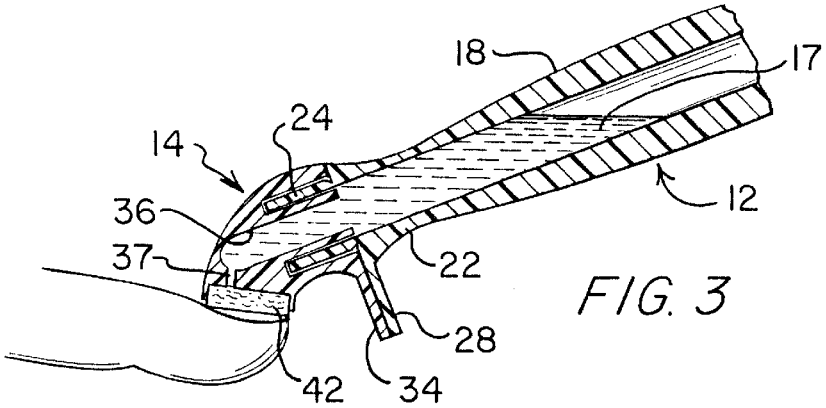
FIG. 3 is partial sectional view of the fingernail tool for use in removing nail polish according to the present invention illustrating it in use applying nail polish remover to a fingernail.
Figure 1:
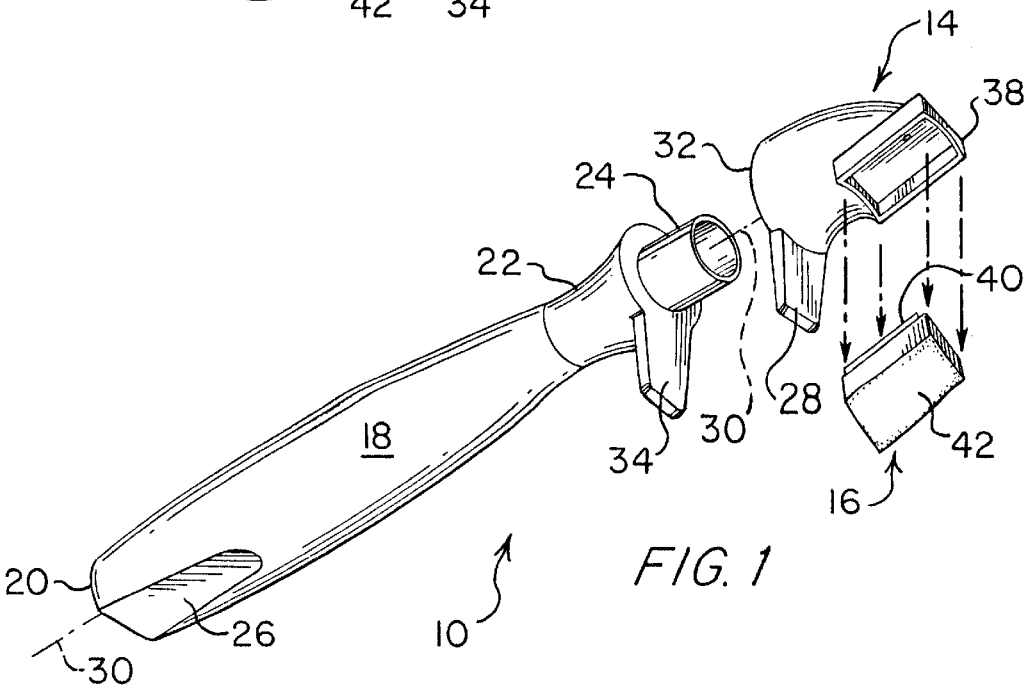
FIG. 1 is an exploded top, front perspective view of the fingernail polish removal tool of the present invention.

Referring now to FIG. 1, fingernail polish removal tool of the present invention is illustrated, indicated generally as 10. The removal tool 10 includes a hollow handle 12 and a removable open end in the form of hollow cap 14, and a cleaning pad 16. In preferred embodiments, cleaning pad 16 is removable and replaceable. The hollow cap 14 is shown separated from the hollow base handle 12, and the removable and replaceable cleaning pad 16 is shown separated from the hollow cap 14. As set forth in greater detail below, the removal tool 10 is a hand held tool which is designed and adapted to carry nail polish removal fluid 17 in the hollow base handle 12 for use in wetting the cleaning pad 16. The cleaning fluid wetted cleaning pad 16 may then be used, to clean nail polish from individual's nails, as illustrated in FIG. 3. The removal tool 10 is fashioned for use by both professional nail technicians and by individuals for removing nail polish from a single finger nail, like magic, without damaging the nail polish on any other finger nails, as commonly occurs when using cotton balls for nail polish removal.

The hollow base handle 12 has a modified cylindrical surface 18, a closed distal end 20, and a neck portion 22, and a connecting portion 24 having an open end. In cross-section, the open ended connecting portion 24, the neck portion 22, and the handle portion 12 have substantially circular cross-sections. The outside diameter of the middle portion of the hollow base handle 12 is greater than the outside diameter of the neck portion 22, and the outside diameter of the neck portion 22 is greater than the outside diameter of the open ended connecting portion 24. By providing the middle portion of the hollow base handle 12 with an outside diameter greater than the outside diameter of the open ended connecting portion 24 and the neck portion 22, the hollow base handle 12 is easier and more comfortable to grasp in the hand of the user.

Figure 2:
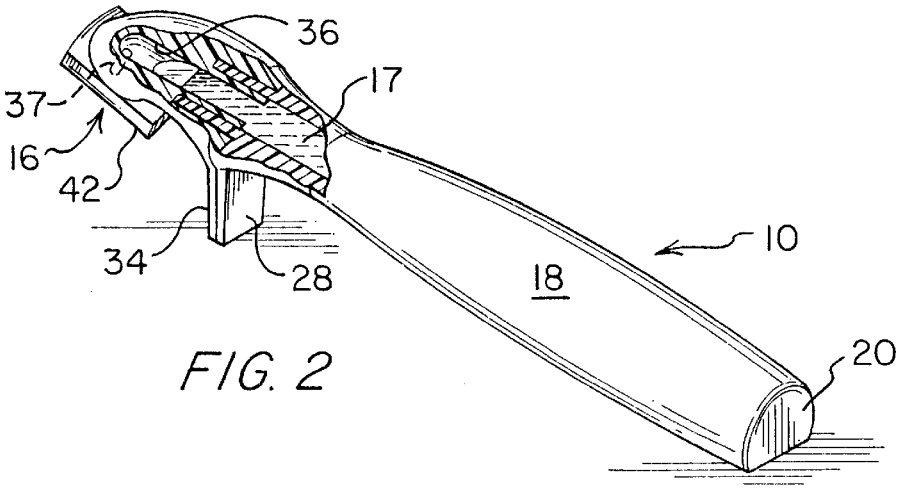
FIG. 2 is a top, rear perspective view, partially in section of the fingernail polish removal tool according to the present invention illustrating the tool positioned upon a substantially level horizontal surface.

The hollow base handle 12 also carries a planar surface 26 formed in the outside surface 18 adjacent to the closed distal end 20. The planar surface 26 is oriented at an angle to the central axis 30 of the hollow base handle 12. In addition, a base rest 28 is provided intermediate the neck portion 22 and the connecting portion 24, and extends substantially perpendicular to the longitudinal axis 30 of the hollow base handle 12. The base rest 28 is located on the same side of the hollow base handle 12 as the planar surface 26 and defines a stable plane with the planar surface 26. The planar surface 26 has an angle, and the base rest 28 has a length and width dimension such that when the removal tool 10 is positioned with the planar surface 26 and the base rest 28 both in normal contact with a level surface, not shown, the removal tool 10 is in a stable attitude with the open ended connecting portion 24 higher than the body of the hollow base handle 12. This allows the removal tool 10 to be put down in a in a stable resting position so that any nail polish remover fluid 17 in the hollow base handle 12 will not flow through the second open ended portion 37 of hollow cap 14, as illustrated in FIG. 2. Not only does such a resting position structure allow a user to easily and conveniently put the removal tool 10 down in a resting position, but it also keeps the nail polish remover fluid 17 stored within the base 12.

The connecting portion 24 is designed to receive a corresponding open attaching end 32 carried by the removable cap portion 14. The attaching portions 24 and 32 are sized and shaped to be releasably connectable to one another by friction fit, although other types of attaching mechanisms may be used. The removable hollow cap 14 also carries a cap rest 34 which substantially matches the size and shape of the base rest 28 of the hollow base handle 12. The cap rest 34 serves to further support the removal tool 10 when it is resting on a substantially level surface.

The removable cap 14 is hollow, and includes a first open end 35 and a passageway 36 terminating in a second open end 37. The removable cap portion 14 further includes a cleaning pad seat 38 which is open to the second open end 37 for receiving and holding the removable and replaceable cleaning pad 16. The cleaning pad seat 38 is opposed to the open attaching end 32 of the removable cap 14 and is preferably formed integrally therewith. The leaning pad seat 38 releasably secures the cleaning pad 16 to the cap portion 12. In the preferred embodiment which is shown, in order to reduce material costs and the need for extraneous connection mechanisms, the cleaning pad 16 is preferably frictionally fitted into the pad seat 38. However, any other type of securement means can be utilized to releasably secure the cleaning pad 16 to the applicator pad seat 38. For example, the applicator pad seat 38 can be modified by art known means to allow the cleaning pad 16 to be slip fit sideways into the cleaning pad seat 38.

The cleaning pad 16 is preferably comprised of two layers, a lower securement segment 40 and a connected upper cleaning portion 42. Preferably, both the securement segment 40 and the cleaning portion 42 are formed from a disposable, porous material, such as sponge or artificial sponge, which will allow the applicator pad 16 to controllably absorb and dispense nail polish remover fluid 17 flowing through the passageway 36 and the second open end 37. The applicator material is also selected so that it will not leave a residue on the nails of the user as commonly occurs when using cotton materials for nail polish removal.

The base 12 and the cap 14 are preferably constructed from a durable, shatter resistant material, such as molded plastic, although other suitable materials such as ceramic or metal may be used. Furthermore, in preferred embodiments, the base 12 and the cap 14 are formed from the same material. However, it should be noted that it is within the scope of the present invention to form the base 12 and the cap 14 from different, yet compatible, materials. The cylindrical surface 18 is preferably substantially smooth, but it may have a textured, knurled, grooved or ribbed surfaces either for aesthetic purposes or to provide the user with a better grip when grasping the removal tool 10. While the cap portion 14 is preferably releasably secured to the base 12, the cap portion 14 may also be formed integral to the base 12. In such an integrated removal tool 10, the nail polish remover fluid 17 may be introduced into the removal tool 10 through the opening in the cleaning pad seat 38 of the cap portion 14, or otherwise, for example through a sealable opening in the base 12 not shown.

To use the removal tool 10 of the present invention, first the user will remove the cap portion 14 from the base 12. Next, nail polish remover fluid 17 is carefully poured through the open ended connecting portion 24 into the hollow base handle 12 for the storage. The cap portion 14 is then releasably secured onto the connecting portion 24 of hollow base handle 12. When the removal tool 10 is to be used to remove nail polish from a nail, the removal tool 10 is positioned with the open ended connecting portion 24 lower than the closed distal end 20 so that the nail polish remover fluid 17 flows toward the cap portion 14 and into the cleaning pad 16. The cleaning pad 16 will retain the nail polish remover fluid 17 until pressure is applied to the cleaning pad 16 by pressing it against a to-be-cleaned finger nail thereby, allowing the nail polish remover fluid 17 to be dispensed onto the nail. The amount of nail polish remover fluid 17 which is dispensed by the cleaning pad 16 of removal tool 10 is substantially directly proportional to the amount of pressure applied to the cleaning pad 16 by the user. The control provided by the removal tool 10 of the present invention enables the user to assure that only a desired amount of nail polish remover fluid 17 is dispensed, thereby allowing the maintenance of a clean and neat environment while providing a professional and magnificent nail cleaning operation, like magic.

When the cleaning pad 16 becomes soiled, it can be pulled from the applicator pad seat 38, for example by hand or preferably using a tweezers type of tool, and then replaced with a fresh cleaning pad 16 fitted into the pad seat 38.

When removal tool 10 is to be stored it is placed on a flat, level surface with the planar surface 26 and the base rest 28 and the cap rest 34 both in normal contact with the level surface. When so positioned, the removal tool 10 is in a stable attitude with the open ended connecting portion 24 higher than the rest of the hollow base handle 12 so that nail polish remover fluid 17 in the hollow base handle 12 can not drip from the removal tool 10.

The foregoing exemplary descriptions and the illustrative preferred embodiment of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

The embodiments of the invention for which an exclusive privilege and property right is claimed are defined as follows:

1. A nail polish removal tool for use with a nail polish remover applicator for removing nail polish from fingernails, said tool comprising:

a hollow base portion including a fluid reservoir, said hollow base portion having a closed distal end, an open end opposed to said closed distal end, nail polish remover fluid being receivable into said reservoir through said open end;

a hollow cap portion adapted to be removably secured in fluid tight connection to said open end of said hollow base portion, said hollow cap portion having a first open end which is open to said open end portion of said hollow base portion when said hollow cap portion is secured to said open end of said hollow base portion, and a second open end portion spaced from said first open end, said second open end portion being adapted to receive a nail polish remover fluid applicator, nail polish remover fluid being receivable into said first open end of said hollow base portion and thence through said hollow cap portion to said second open end portion from said hollow base portion; and at least two rest members, a first rest member being secured to said hollow base portion in the vicinity of said open end of said hollow base portion and a second rest member being secured to said hollow cap portion in the vicinity of said first open end of said hollow cap portion, said rest members being of a height dimension such that when said reservoir of said hollow base portion is filled with fluid, and said nail polish removal tool is placed on a substantially flat surface resting on its said distal end and on said at least two said rest members said nail polish removal tool is stable and the height of the fluid within said nail polish removal tool is below the then resting height of said second open end of said hollow cap portion.

2. The removal tool of claim 1 wherein said first rest member and said second rest member are adjacent to one another.

3. The removal tool of claim 1 wherein said first rest member and said second rest member are oriented in the same direction.

4. The removal tool of claim 1 wherein said second open end of said cap portion which is adapted to receive a nail polish remover fluid applicator includes a seat for releasably securing a nail polish remover fluid applicator.

5. The removal tool of claim 4 wherein a nail polish remover fluid applicator is releasably secured within said seat.

6. The removal tool of claim 5 wherein said nail polish remover fluid applicator is releasably secured within said seat by a mechanism selected from the group consisting of sliding friction, slide fit, and mechanical connection, and combinations thereof.

7. The removal tool of claim 5 wherein said nail polish remover fluid applicator is a porous material removably secured to said seat of said cap portion, nail polish remover fluid being receivable into said porous applicator material from said reservoir in said hollow handle and through said hollow cap portion when said nail polish removal tool is oriented in a manner such that the height of the fluid within said tool is above the height of said second open end of said hollow cap portion, said porous applicator material substantially retaining said nail polish remover fluid, wherein contacting pressure of said porous applicator material with a fingernail releases at least a portion of such nail polish remover fluid from said porous applicator material onto the fingernail, and wherein further, when said nail polish removal tool is placed on a substantially level surface resting on its said distal end and on said at least two said rest members said nail polish removal tool is stable and the height of the fluid within said nail polish removal tool is below the then resting height of said second open end of said hollow cap portion, and thence out of contact with said porous applicator material.

8. The removal tool of claim 7 wherein said porous applicator material comprises a cleaning pad comprised of a first layer and a second layer, said first layer being adapted to be secured to said seat of said cap portion and said second layer including an outer surface adapted for applying the nail polish remover fluid to a fingernail and the like.

9. The removal tool of claim 1 further comprising a planar surface angularly formed at said outer surface of said distal end of said hollow base portion, said planar surface cooperating with said at least two rest members allowing the removal tool to be positioned in a substantially stable resting position on a substantially level horizontal surface.

10. The removal tool of claim 1 wherein said at least one rest member is secured to said hollow base portion in the vicinity of said open end of said hollow base portion.

11. The removal tool of claim 1 wherein said at least one rest member is secured to said hollow cap portion in the vicinity of said first open end of said hollow cap portion.

12. The removal tool of claim 1 wherein there are two rest members, a first rest member being secured to said hollow base portion in the vicinity of said open end of said hollow base portion and a second rest member is secured to said hollow cap portion in the vicinity of said first open end of said hollow cap portion.

13. A nail polish removal tool for use with a nail polish remover applicator for removing nail polish from fingernails, said tool comprising:

a hollow base portion including a fluid reservoir, said hollow base portion having a closed distal end, an open end opposed to said closed distal end, nail polish remover fluid being receivable into said reservoir through said open end;

a hollow cap portion adapted to be removably secured in fluid tight connection to said open end of said hollow base portion, said hollow cap portion having a first open end which is open to said open end of said hollow base portion when said hollow cap portion is secured to said open end of said hollow base portion, and a second open end portion spaced from said first open end, said second open end portion being adapted to receive a nail polish remover fluid applicator, nail polish remover fluid being receivable into said first open end of said hollow base portion and thence through said hollow cap portion to said second open end portion from said hollow base portion; and at least one rest member secured to said nail polish removal tool in the vicinity of said open end of said hollow base portion, said at least one rest member being of a height dimension such that when said reservoir of said hollow base portion is filled with fluid, and nail polish removal tool is placed on a substantially flat surface resting on its said distal end and on said at least one said rest member said nail polish removal tool is stable and the height of the fluid within said nail polish removal tool is below the then resting height of said second open end portion of said hollow cap portion.

14. In a nail polish removal tool for use in selectively distributing nail polish removing fluid for use in removing nail polish from fingernails, the nail polish removal tool having a hollow portion having a reservoir for storing nail polish removing fluid, means for allowing the placement of nail polish removing fluid into said reservoir, means for securing a nail polish removing fluid applicator to said tool, the nail polish removing fluid being receivable from the reservoir into the applicator portion through an open end portion, a closed distal end substantially opposed to said open end portion, and wherein contacting pressure of the fluid applicator with the finger nail releases nail polish removing fluid from the fluid applicator onto a finger nail, the improvement comprising:

at least two protruding members secured to said nail polish removal tool, said at least two protruding members being so located and of a height dimension such that when said reservoir of said hollow portion is filled with fluid, and said nail polish removal tool is placed on a substantially flat surface resting on its said distal end and on said at least two protruding members said nail polish removal tool is stable and the height of the fluid within said nail polish removal tool is below the then resting height of said open end portion.

15. In a liquid applicator for selectively distributing liquid to an article, the liquid applicator having a hollow base portion, a cap portion secured to the hollow base portion, and a porous material removably secured to the cap portion, the liquid being receivable from the hollow base portion into the cap portion and into the porous material, and wherein contacting pressure of the porous material with the article releases at least a partial amount of the liquid from the porous material onto the article, the improvement comprising:

at least two protruding members, a first protruding member extending from the hollow base portion and a second protruding member extending from the cap portion, the protruding members maintaining a liquid level of the liquid below the porous material when the liquid applicator is positioned upon a substantially horizontal surface.

16. A method for removing nail polish from a fingernail, and storing nail polish remover fluid, the method comprising:

introducing nail polish remover fluid into a reservoir in a hollow base portion having a first open distal end and a second closed distal end;

securing a cap portion to the first open distal end of the hollow base portion, the nail polish remover fluid receivable into the cap portion from the first open distal end of the hollow base portion;

removably securing an applicator material to the cap portion, the nail polish remover fluid being receivable into the applicator material from the cap portion and substantially retainable within the applicator material, and wherein the combined hollow base portion, cap portion, and applicator material comprise a nail polish removal tool, and further including at least two protruding members one secured to the hollow base portion and a second secured to the cap portion of said nail polish removal tool;

applying pressure to the applicator material with a to-be-cleaned fingernail thereby releasing at least a partial amount of the nail polish remover from the applicator material onto the fingernail; and placing the nail polish remover tool upon a substantially level horizontal surface resting on its second closed distal end and on at least two said protruding members so that the liquid level of the nail polish remover is maintained at a position below the applicator material.

* * * * *